US010065214B2

(12) United States Patent
Timmerman et al.

(10) Patent No.: US 10,065,214 B2
(45) Date of Patent: Sep. 4, 2018

(54) APPARATUS, SYSTEM AND METHOD FOR FOLDING A SCREEN FOR USE WITH A SCREEN TENSIONING SYSTEM

(71) Applicant: M-I L.L.C., Houston, TX (US)

(72) Inventors: Michael A. Timmerman, Cincinnati, OH (US); Robert A. Lunnemann, Florence, KY (US); Mark Heitfeld, Cleves, OH (US)

(73) Assignee: M-I L.L.C., Houston, TX (US)

( * ) Notice: Subject to any disclaimer, the term of this patent is extended or adjusted under 35 U.S.C. 154(b) by 64 days.

(21) Appl. No.: 15/085,615

(22) Filed: Mar. 30, 2016

(65) Prior Publication Data

US 2017/0282216 A1 Oct. 5, 2017

(51) Int. Cl.
*B07B 1/46* (2006.01)
*B07B 1/48* (2006.01)

(52) U.S. Cl.
CPC ..... *B07B 1/48* (2013.01); *B07B 1/46* (2013.01); *B07B 2201/02* (2013.01)

(58) Field of Classification Search
CPC ..... B07B 1/46; B07B 1/4609; B07B 1/48; B07B 1/49; B07B 2201/02
USPC ..... 209/319, 399, 403, 405, 408
See application file for complete search history.

(56) References Cited

U.S. PATENT DOCUMENTS 1,999,769 A * 4/1935 Lincoln ..... B07B 1/48 209/403
2,314,879 A * 3/1943 Heller ..... B07B 1/282 209/403
3,346,114 A * 10/1967 Hoyt ..... B07B 1/48 209/403
5,046,545 A * 9/1991 Loomis ..... B44D 3/185 160/328
5,408,770 A * 4/1995 Suzuki ..... E04G 5/12 160/368.1
6,220,448 B1 * 4/2001 Bakula ..... B07B 1/4618 209/392
6,283,303 B1 * 9/2001 Lane ..... B07B 1/46 209/399
6,454,099 B1 * 9/2002 Adams ..... B01D 29/012 209/399
6,520,341 B2 * 2/2003 Suter ..... B07B 1/48 209/363
6,701,994 B2 * 3/2004 Goldenberg ..... E06B 9/54 160/120
7,344,032 B2 * 3/2008 LaVeine ..... B07B 1/46 209/310

(Continued)

*Primary Examiner* — Joseph C Rodriguez
(74) *Attorney, Agent, or Firm* — Paula B. Whitten

(57) ABSTRACT

An apparatus, a system and a method for reinforcing a screen has a screen rod assembly extending from a first end to a second end. The screen rod assembly encloses an interior. A spring-loaded plunger is located in the interior and adjusts the length of the screen rod assembly. A ball joint is on the screen rod and defines sections of the screen rod assembly that bend around the ball joint to reduce the length of the screen rod. A sleeve extends from a screen with segments separated by a fold line extending along a width of the screen. The sleeve receives the screen rod assembly to reinforce the screen. In an embodiment, a screen pinch assembly is defined where the sleeve engages a retention clasp of a screen tensioning system that receives the screen. The screen pinch assembly holds the screen in place.

21 Claims, 5 Drawing Sheets

(56) References Cited

U.S. PATENT DOCUMENTS

| | | | | |
|---|---|---|---|---|
| 7,520,391 | B2 * | 4/2009 | Schulte, Jr. | B01D 29/012 209/405 |
| 7,866,482 | B2 * | 1/2011 | Barrett | B07B 1/46 209/385 |
| 7,918,346 | B2 * | 4/2011 | Roppo | B07B 1/485 209/405 |
| 8,225,938 | B2 * | 7/2012 | Malmberg | B07B 1/46 209/405 |
| 8,810,909 | B2 * | 8/2014 | Risher | G03B 21/56 359/443 |
| 2017/0282216 | A1 * | 10/2017 | Timmerman | B07B 1/48 |

* cited by examiner

APPARATUS, SYSTEM AND METHOD FOR FOLDING A SCREEN FOR USE WITH A SCREEN TENSIONING SYSTEM

BACKGROUND OF THE INVENTION

In certain industries and/or applications, separating a material from another material is often desired and/or required. Further, the separation of solids and fluids is generally known in a variety of industries and/or applications. For example, industrial separators use screens to separate solids and/or fluids. Also, the mining industry has many applications in which solids may be separated from fluids to extract a desired ore and/or metal during mining processes. Moreover, in the petroleum and/or oilfield operations industries, on-shore and/or off-shore drilling applications use various methods and/or equipment to separate solids from fluids in drilling processes.

Conventional vibratory screen apparatus for sifting material generally use screens with either a hook-strip or a pre-tensioned design. Hook-strip screens generally have a single layer of mesh or multiple layers of mesh bonded together. The screens may be tensioned after the screens are mounted in a basket associated with the vibratory screen apparatus. Opposite sides of the screen are fitted with a hook-strip formed by a turn-back element. The hook-strip may be hooked around and/or attached on a tension rail which may be attached to the side wall of the basket. A tension bolt may be used to secure the hook-strip. Other loading means to apply tensioning and securing forces to secure the hook-strip may be used. Tightening the tension bolt may move the tension rail outwardly towards the walls of the basket to apply and/or transfer tension to the screen.

Hook-strip screens may be pre-tensioned prior to mounting in the basket by attachment of the screen mesh element to an apertured support plate, typically by an adhesive. A screen having a plurality of mesh layers may be pre-tensioned. In some designs, multiple integrated mesh layers may be corrugated prior to mounting to an apertured support plate associated with the basket. Hooks may be engaged with corresponding eyelets on the apertured support plate to form the mesh-plate combination.

Hook-strip screens may be relatively complex and require substantial skill to assemble and/or to prepare for use. Mounting of screen members on the basket may result in significant downtime of the vibratory screen apparatus and also involve the use of multiple parts. Configuring the basket and/or hook-strip screen to attain a desirable screen tension to process incoming sieved material may involve fine tuning.

Further, the hook-strip screen may be damaged if excessive force is applied when tightening attachment bolts, screws, connectors and/or the like to tension the hook-strip screen. In addition, irregularities in the hook-strip screen, attachment bolts and/or the like may cause poor sealing between the hook-strip screen and the basket. For instance, a metal on a metal seal may cause leakage. Unscreened material may pass through gaps between the screen and the basket and may mix with and/or pollute screened material below a filtration mesh of the hook-strip screen. Attempts to overcome the poor seal by placing rubber strips and/or gaskets at metal/metal interfaces may require intricate and time-consuming fitting procedures. The rubber strips and/or gaskets frequently loosen during vibration and may become lost or lodged in the vibratory apparatus to obstruct and/or otherwise damage the machinery. In addition, applying tension to the screen when tightening the tension bolt may add undesirable stress to the machine frame.

Pre-tensioned screens may have one or more layers of mesh permanently bound under tension to a rigid steel and/or plastic apertured plate support frame. The mesh screen may be flat or crowned. The mesh screen and support frame are inserted into the basket as a unit which requires no adjustment to the tension of the screen. The mesh screen and the support frame are normally secured in the machine by clamps from above and/or below. The clamps may be hydraulic pistons, inflatable clamping bags, bolts, tapered elements and/or the like.

Conventional pre-tensioned screen units with integrated support frames may be bulky, heavy and difficult to handle, transport and/or store. Typically, the design of such screen units may be complex, and the frames may be expensive to construct. Plastic injection molding is commonly used which is an inflexible method of construction. The frames utilize large amounts of material which require disposal when the screen units are replaced. The disposal may be inconvenient, expensive and/or may negatively impact the environment.

Over the life of the screen, the particles cause wear on the wire mesh. Damage causes a breach in the mesh. As a result, the area of the mesh allows larger particles to pass through than desired. After the damage occurs, the screen must be replaced or repaired.

Many conventional screens may be large and cumbersome to handle during transportation, installation and/or removal. Handling and/or manipulating the screens is difficult for a single user. The screens may be relatively large in size and may also be rigid, both of which increase the difficulty in removing the screen from the vibratory separator.

Also, the rigid screens are difficult to transport and/or store. In certain situations in which the available space surrounding the separator is limited, maneuvering the screens for installation and/or replacement is challenging.

A need exists for a screen to allow the screen to fold, roll and/or coil without causing a permanent raised crease. The reduced size screen may be more easily carried and/or transported.

DETAILED DESCRIPTION

Embodiments disclosed herein are applicable to separation devices that may be utilized in numerous industries. While specific embodiments may be described as utilized in the oilfield services and related industries, such as use with shale shakers, the device may be applicable in other industries where separation of liquid-solid, solid-solid and other mixtures may be separated. The embodiments may be utilized in the mining, pharmaceutical, food, medical or other industries to separate such mixtures.

In the following detailed description, reference is made to accompanying figures, which form a part hereof. In the figures, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined and designed in a wide variety of different configurations, which are explicitly contemplated and form part of this disclosure.

Figure 1:
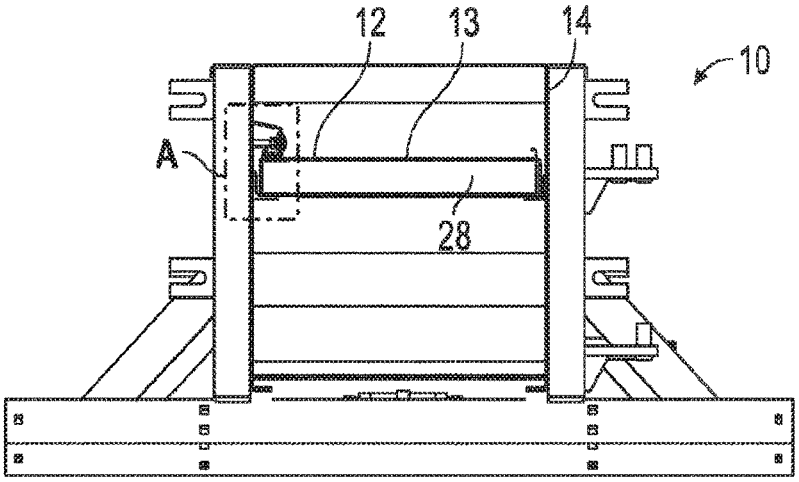
FIG. 1 (Prior Art)
FIG. 1 illustrates a prior art vibratory screen apparatus having a screen with a hook strip.
Figure 2:
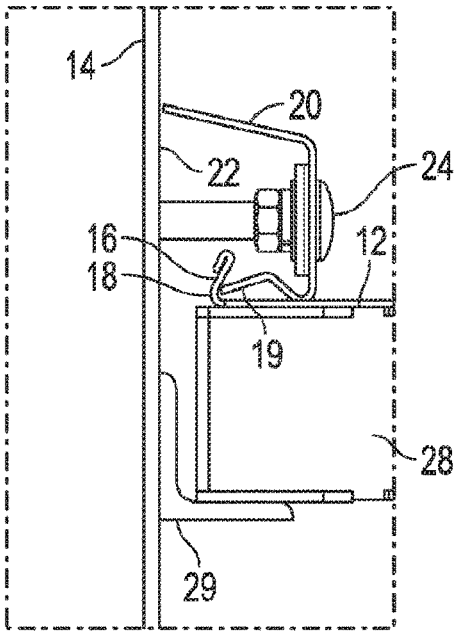
FIG. 2 (Prior Art)
FIG. 2 illustrates a detail view of the prior art hook strip located within box "A" of FIG. 1.

FIG. 1 illustrates a vibratory screen apparatus, commonly referred to as a separator 10. The separator 10 shown in FIG. 1 has a hook strip screen 12. The connection of the hook strip screen 12 is also illustrated in greater detail in FIG. 2. Generally, the hook strip screen 12 may have a single layer of mesh 13. Multiple layers of mesh may also be bonded together. The mesh 13 is tensioned after mounting the hook strip screen 12 in a basket 14 of the separator 10. Two opposed ends of the hook strip screen 12 are fitted with a turn back element 16 to form a hook strip 18 which are hooked around a retaining portion 19 of a tension rail 20. For simplicity, FIG. 1 illustrates a left side connection for the hook strip screen 12.

The tension rail 20 is attached to a side wall 22 of the basket 14. The tension rail 20 is attached via a tension bolt 24. Tightening the tension bolt 24 moves the tension rail 20 outwardly towards the interior walls 22 of the basket 14 of the separator 10 to apply tension to the hook strip screen 12. The retaining portion 19 of the tension rail 20 is pressed against the hook strip 18. The hook strip screen 12 is stretched over a crowned deck (not shown). The resulting arcuate profile of the hook strip screen 12 retains rigidity of the hook strip screen 12 during vibratory motion of the separator 10.

The hook strip screen 12 is located above a rectangular shaped ball box 28. The ball box 28 is held in the basket 14 of the separator 10 on a ball box rail 29. The ball box 28 contains balls and/or other objects (not shown) of various shapes and/or sizes therein. The objects may move during vibratory motion produced during operation of the separator 10. The movement of the objects impacts the hook strip screen 12 above the ball box 28 to prevent clogging of solids in apertures in the hook strip screen 12. The ball box 28 is supported by rails 30 attached to the interior walls 22 of the basket 14 of the separator 10.

Figure 3:
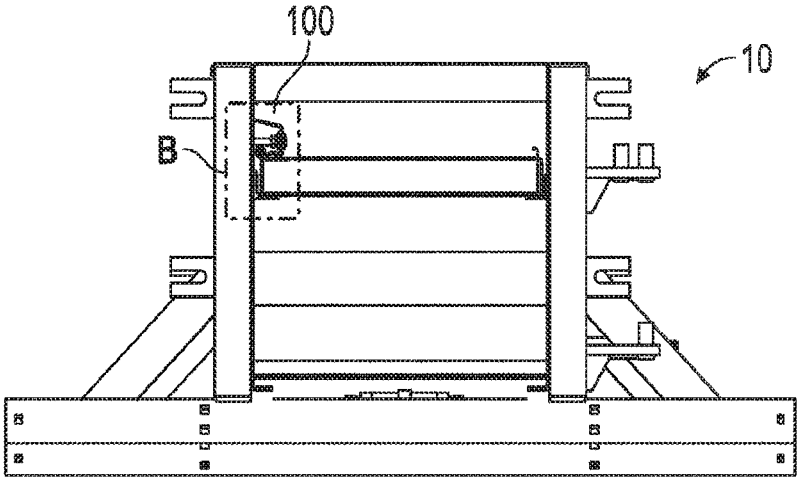
FIG. 3 illustrates an elevation view of a vibratory screen apparatus having a screen rod tensioning system in accordance with an embodiment of the invention.
Figure 4:
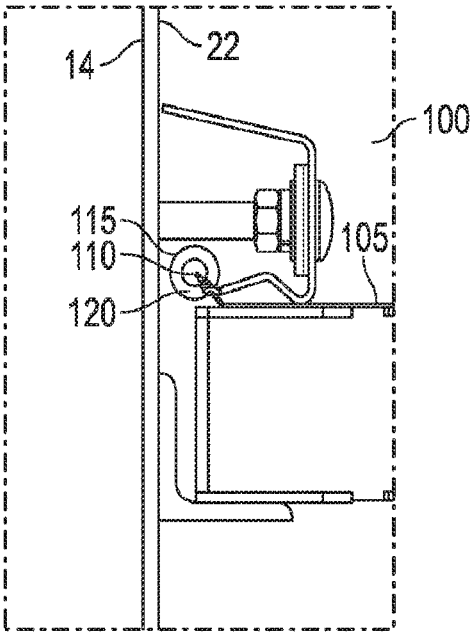
FIG. 4 illustrates a detailed view of the screen rod tensioning system within box "B" of FIG. 3 in accordance with an embodiment of the invention.

Referring to FIGS. 3 and 4, an embodiment of a screen rod tensioning system 100 is shown. Specifically, FIG. 4 illustrates a detailed side view of a left side connection for the screen rod tensioning system 100 shown in box B of FIG. 3. The right side connection for the screen rod tensioning system 100 may be provided in the same manner.

In an embodiment, the screen rod tensioning system 100 may have a screen 105 with one or more layers of wires, mesh or other substances that may be used to form apertures for separating particles of different sizes. The screen 105 may have mesh sized to separate predetermined sized particles. For example, the screen 105 may have mesh sized to separate a first sized solid from a second sized solid, desired solids form contaminants, liquid from solids, such as drill cuttings from drilling fluid. Mesh size may refer to the size of apertures in the screen 105.

The screen 105 may have a length and a width defined in a direction transverse to the length. The screen 105 may have a profile 110 positioned at the ends of the screen 105, such as on the edges of the screen 105. The profile 110 may be molded, attached or otherwise secured on opposing sides of the screen 105, such as along the length of each end of the screen 105. The profile 110 may have a circular or elliptical cross-section as shown. However, other shapes and/or cross-sections may be used. The profile 110 may be formed from a material with sufficient rigidity to maintain the shape of the profile 110. However, the profile 110 may be made from a material that may permit rolling the screen 105 width-wise instead of length-wise.

Thus, the screen rod tensioning system 100 may allow the screen 105 to be rolled width-wise. For example, a traditional five foot by twelve foot screen may require a twelve foot long tube for shipping and/or transport. The screen rod tensioning system 100 may allow the same size screen to be shipped in a five foot long tube. The reduction in size may improve the ease of handling the screen 105.

The screen rod tensioning system 100 may have a rod 115. The rod 115 may have a channel 120 to receive the profile 110 formed on the edge of the screen 105. For example, the channel 120 in the rod 115 may have a matching cross-section to accommodate the cross-section of the profile 110. As shown, the circular cross-section of the profile 110 may fit within the circular cross-section of the channel 120. The channel 120 may be sized slightly larger than the profile 110 so that the rod 115 may slide down the length L of the profile 110 of the screen 105 on both sides.

Thus, the profile 110 of the screen 105 may be inserted into the rod 115 in the screen rod tensioning system 100. As shown in FIGS. 3 and 4, the rod 115 may be held in place by the retaining portion 19 of the tension rail 20. Tightening the tension bolt may move the retaining portion 19 of the tension rail 20 outwardly towards the interior walls 22 of the basket 14 of the separator 10 to apply tension to the screen 105. The retaining portion 19 of the tension rail 20 may also move the rod 115 outwardly towards the interior walls 22 of the separator 10 to apply tension to the screen 105.

The screen rod tensioning system 100 may also eliminate the need for sectional screens in the separator 10. Some installations may not have adequate space around the separator 10 to install a full twelve foot screen, for example. For such installations, the use of sectional screens may be required. Typically, the sectional screens may be smaller sized screens installed adjacent to each other in the separator 10 to fill the basket 14 of the separator 10. However, sectional screens may be cumbersome and may create additional opportunities for bypass of the slurry.

In other embodiments, the screen rod tensioning system 100 may use different length rods arranged end-to-end on a common axis instead of one twelve foot rod 115.

Further, the screen rod tensioning system 100 may allow replacement of the screen 105. During use of the screen 105 in industrial filtration systems, the screen 105 may become damaged. For example, the screen 105 may be used in the separator 10, shown in FIG. 1, to separate solids of a first size from solids of a second size. Such environments may be destructive to the screen 105 over a period of extended use and/or from repeated exposure to the solids. Periodic inspections of the screen 105 may indicate that damage may have occurred to the screen 105. The user may remove the screen 105 for replacement with a new screen 105. In an embodiment, the three four foot rods arranged end-to-end may be removed from the separator 10 one four foot segment at a time. The screen 105 may be folded at the end of each four foot rod as each four foot rod is removed from the separator 10 to form four foot folded sections of the screen 105.

Figure 5:
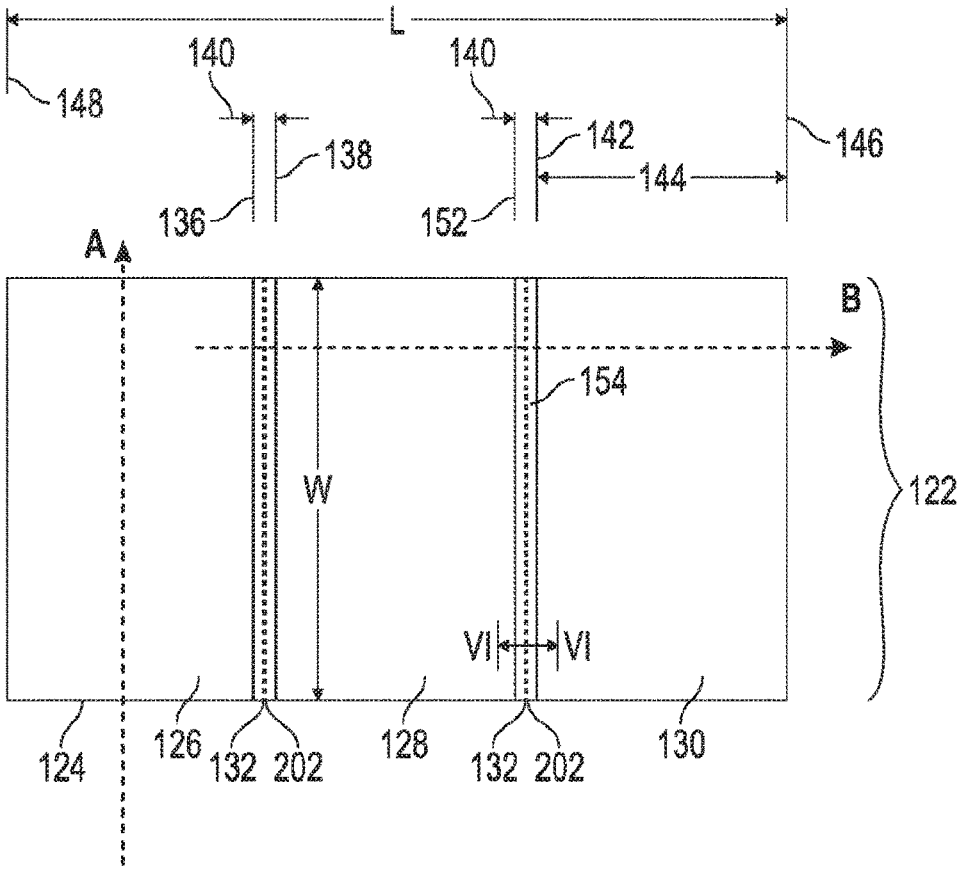
FIG. 5 illustrates a front view of a segmented screen with a hinge between each segment of the segmented screen in accordance with an embodiment of the invention.

Referring to FIG. 5, a screen 122 is shown with hinges 132 separating segments 124 of the screen 122. The hinges 132 may fold in direction B. In an embodiment, the screen 122 may be referred to as a foldable screen and/or as a screen with a living hinge. Generally, a living hinge may refer to a relatively thin flexible hinge, i.e. a flexure bearing, made from the same material as the two pieces connected by the living hinge, rather than being made of a more pliable material. A living hinge may be thinned or cut to allow pieces connected by the living hinge to bend and/or fold along an axis defined by the hinge. The living hinge may produce minimal friction and thus experience relatively low wear, making the living hinge useful in a variety of applications.

In an embodiment, the screen 122 may be equivalent to the screen 105, shown in FIG. 4, and may be used with the screen rod tensioning system 100. The hinges 132 may be made from traditional metal-to-metal linkages and/or may use composite materials to ensure optimal fitment and durability. The hinges 132 may be flush with the segments 124 of the screen 122 to allow for distribution of the material to be separated by the separator 10 across the screen 122.

The screen 122 may have a left side 148 and a right side 146 and may be rolled and/or coiled in direction A as shown in FIG. 5 parallel to the left side 148 and the right side 146. The hinges 132 may extend along a width W and may allow for the segments 124 to fold inward, i.e. transverse to direction A, to reduce a length L, shown in FIG. 5, of the screen 122 defined between the left side 148 and the right side 146. In an embodiment, the length of the screen 122 may be approximately twelve feet and the width W, shown in FIG. 5, of the screen 122 may be approximately five feet. Each segment 124 may have a segment length 144 of approximately four feet along the length direction B. Accordingly, three segments 124 may have a combined length L of approximately twelve feet. Further, the segments 124 may have a left segment 126, a center segment 128 and a right segment 130.

The hinge 132 between the left segment 126 and the right segment 128 may be centered between a left interface side 136 and a right interface side 138. An connection interface length 140 may extend from the left interface side 136 to the right interface side 138. An interface material 154, such as a flexible adhesive backed material, Velcro, tape, bonding substances, or other materials capable of securing segments 124 along the hinge 132. The interface material 154 may extend along the connection interface length 140 to adhere, for example, the left segment 126 to the center segment 128. In an embodiment, the connection interface length 140 may be approximately four inches. Further, in an embodiment, the connection interface length 140 may be shorter than four inches. The connection interface length 140 to prevent the segments 124 from butting together to allow for folding of the screen hinge 132 without damaging the screen 122.

The left segment 126 may be folded along the hinge 132 between the left segment 126 and the center segment 128 to reduce the length L of the screen 122. The interface material 154 extending across the connection interface length 140 may adhere the left segment 126 to the center segment 128 along the connection interface length 140 when folded.

The right segment 130 may be folded along the hinge 132 toward the center segment 128 to reduce the length L of the screen 122. The connection interface length 140 may extend from a left interface side 152 to the right interface side 142. The interface material 154 extending across the connection interface length 140 may adhere, connect or secure the right segment 130 to the center segment 128 along the connection interface length 140 when folded.

Figure 6:
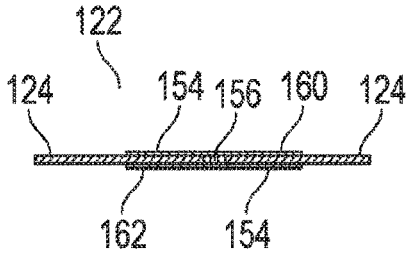
FIG. 6 illustrates a cross-sectional view of a segmented screen with a hinge taken generally along the line VI-VI of FIG. 5 in accordance with an embodiment of the invention.

Referring to FIG. 6, a cross-sectional view taken along line VI-VI of FIG. 5 of the screen 122 is shown. In an embodiment, the screen 122 may be reduced along the length L by folding either exterior segments, i.e. the left segment 126 and/or right segment 130, toward the center segment 128. A gap 156 may separate the segments 124 to allow for bending of the screen hinge 132 along direction B as shown in FIG. 5. Specifically, in an embodiment, the gap 156 may provide sufficient space between the segments 124 to allow for bending of the segments 124. For example, one of the segments 124 may be separated from one of the other segments 124 by the gap 156 to permit folding one of the segments 124 with respect to the other segment 124 along the screen hinge 132 without the segments 124 contacting each other or otherwise damaging one another. A substance may be positioned in the gap 156 to prevent damaging the segments 124, such as a gas or liquid. The interface material 154 itself may reduce friction and/or otherwise prevent or limit damage to adjoining segments 124 along the hinge 132. The substance in the gap 156 may prevent the segments 124 from contacting and creating friction upon folding of the segments 124 along the screen hinge 132. The interface material 154 to, for example, the left of the gap 156 may adhere to the interface material 154 on the right of the gap 156. The interface material 154 on either side of the gap 156 may adhere to the interface material 154 on the opposing side of the gap 156 upon folding of the hinge 132 to secure the screen 122 in a folded state. In an embodiment, the left segment 126 may be folded along the screen hinge 132 toward the center segment 128. Accordingly, the left segment 126 may adhere to the center segment 128 when folded along the screen hinge 132.

The right segment 130 may be folded along the screen hinge 132 toward the center segment 128. In an embodiment, the left segment 126 may be folded on the center segment 128, and the right segment 130 may be folded on top of the left segment 126. The interface material 154 to the right of the gap 156 may adhere to the interface material 154 to the left of the gap 156 after the right segment 130 is folded on the center segment 128 and/or left segment 126. Accordingly, the length L of the screen 122 may be reduced from a maximum of approximately twelve feet when unfolded, to a minimum of approximately four feet, since each segment 124 may be approximately four feet in length.

In an embodiment, the screen 122 with the width W reduced to approximately four feet, may be rolled and/or coiled in direction A. Thus, the screen 122 may be shipped and/or transported with the length L of approximately four feet, as opposed to the length L of approximately twelve feet when the screen 122 may be unfolded. In an embodiment, the interface material 124 may be applied to a top side 160 of the screen 122 and a bottom side 162 of the screen 122 as shown in FIG. 6. The application of the interface material 124 to the top side 160 and the bottom side 162 may enhance the relative strength of the screen hinge 132 to assist in folding of the screen 122.

Figure 7:
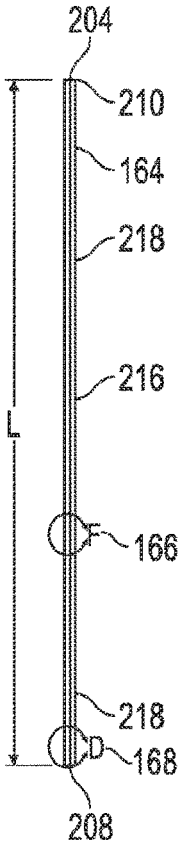
FIG. 7 illustrates a screen rod assembly in accordance with an embodiment of the invention.
Figure 8:
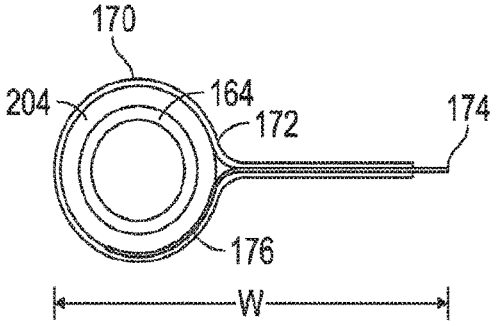
FIG. 8 illustrates a sleeve to attach a screen rod assembly to a screen in accordance with an embodiment of the invention.
Figure 10:
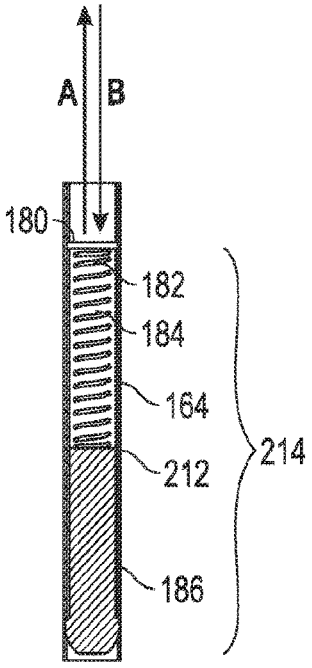
FIG. 10 illustrates a cross-sectional view of a spring contacting a plunger within a screen rod assembly in accordance with an embodiment of the invention.

Referring to FIG. 7, a screen rod assembly 164 is shown with a first junction area 166 and a second junction area 168. In an embodiment, the screen rod assembly 164 may be referred to as a screen rod. The first junction area 166 and/or the second junction area 168 may be positioned generally as shown in FIG. 7 and/or may be positioned along a length L of the screen rod assembly 164. An interior 204 having a width 180, as shown in FIG. 10, of approximately one inch may be enclosed by the screen rod assembly 164. Further, the screen rod assembly 164 may be inserted into and/or threaded through a sleeve 170 as shown in FIG. 8. The sleeve 170, in an embodiment, may be positioned on and/or attach to the screen 122, shown in FIG. 5, at and/or near a junction region 202. In an embodiment, the junction region of the screen may be referred to as a fold line. The sleeve 170 may extend along the junction region 202 along the width W across the screen 122. The junction region 202 with the sleeve 170 accepting the screen rod assembly 164 may, in an embodiment, replace the hinge 132 to allow the segments 124 to fold along the junction region 202. In addition, in an embodiment, the screen 122 may be configured to have the sleeve 170 extend from and/or along the length L and/or the width W of the screen 122 to provide structural reinforcement to the screen 122 for insertion into and/or operation with the screen rod tensioning system 100 as shown in FIGS. 3 and 4, for example.

Figure 12:
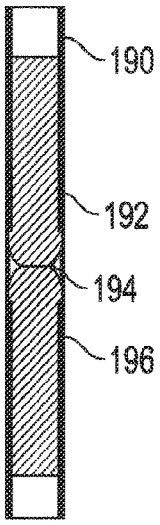
FIG. 12 illustrates a cross-sectional view of a ball joint contacting a pipe within a screen rod assembly in accordance with an embodiment of the invention.

In an embodiment, the first junction area 166 and/or the second junction area 168 may have a ball joint 194 as shown in FIG. 12. In an embodiment, the ball joint 194 may be a flat head ball joint as shown in FIG. 12. The screen rod assembly 164 may have sections 218 defined by the ball joint 194 as shown in FIG. 7. Specifically, the ball joint 194 may allow for the sections 218 to bend and/or to fold around the ball joint 194 to reduce a length L as shown in FIG. 7. The length L of the screen rod assembly 164 may be reduced to accommodate insertion and/or fitment of the screen 122 into the screen rod tensioning system 100.

Referring to FIG. 8, a front view of the sleeve 170 that may receive the screen rod assembly 164 is shown. In an embodiment, the sleeve 170 may extend from the screen 122 along the length L. The screen rod assembly 164 may be inserted and/or threaded through the sleeve 170 along the length L to reinforce the screen 122 and/or to assist in unfolding the segments 124 of the screen 122 prior to the insertion of the screen 122 into the screen rod tensioning system 100. Specifically, the screen 122 may be inserted into and/or attached with the sleeve 170 at an insertion end 174 as shown in FIG. 8. An adhesive layer 176 may partially wrap around the interior 204 of the sleeve 170 to contact with and/or adhere to the screen 122 upon insertion of the screen 122 into the insertion end 174 of the sleeve 170.

Further the sleeve 170 may generally have a width W extending from, for example, the screen 122. The sleeve 170 may extend the width W from the left side 148 and/or the right side 146 of the screen 122 to accommodate insertion and/or installation of the screen 122 into the screen rod tensioning system 100. In an embodiment, the sleeve 170 as shown in FIG. 8 may be enveloped by an adhesive layer 172. The adhesive layer 172 wrap around the sleeve 170 and/or may adhere the sleeve 170 to the segment 124 of the screen 122.

Figure 9:
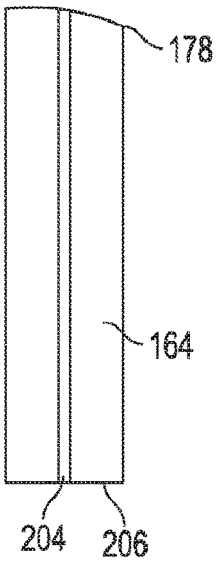
FIG. 9 illustrates a side view of a junction of the screen rod assembly in accordance with an embodiment of the invention.

Referring to FIG. 9, the junction area 168 of the screen rod assembly 164 is shown. An adhesive arc 178 may surround a portion of the screen rod assembly 164 at the junction area 168. The adhesive arc 178 may assist in movement about and/or rotation around the junction area 168. For example, the adhesive arc 178 may assist the screen rod assembly 164 to bend and/or fold the section 218 at the junction area 168 as may be needed for storage and/or transport.

Referring to FIG. 10, a view of a spring 184 contacting a plunger 186 at an interface 212 within the screen rod assembly 164 is shown. The spring 184, the plunger 186 and/or the interface 212 may be collectively referred to as a spring loaded plunger 214 which may be located at and/or toward a first end 208 and/or a second end 210 of the screen rod assembly 164 as shown in FIG. 7. The spring 184 may be a coil spring, for example, shaped generally as a coil and/or helix and may be made from a flexible metal and/or a durable metal. In an embodiment, compressive force may be applied in a direction A as shown in FIG. 10 to compress the spring 184 against a spring pin 182 extending horizontally across the interior 204 of the screen rod assembly 164.

The spring pin 182 may, upon receiving the compressive force in direction A, push the spring 184 toward the interface 182 to essentially shorten the screen rod assembly 164 by pushing the plunger 186 away from, for example, either the first end 208 or the second end 210 of the screen rod assembly 164 to a center 216 of the screen rod assembly 164 as shown in FIG. 7. In an embodiment, compressing the spring 184 in direction A may allow for the segments 124 of the screen 122 to be folded inward toward the center segment 128 to reduce the length L the screen 122 as shown in FIG. 5, for example. Further, in an embodiment, the plunger 186 may be pushed by the compressed spring 184 to contact another plunger 186 in another section 218 to assist in folding of the segments 122.

In an embodiment, a tensile force in a direction B may be applied to pull the spring pin 182 and/or the spring 184 away from the center 216 of the spring rod assembly 164 to, for example, unfold segments 124 of the screen 122 prior to insertion of the screen 122 in the screen tensioning system 100. In an embodiment, the screen pin 182 may lock in place against the interior 204 of the screen rod assembly 164 to prevent additional movement of the screen pin 182, the screen 184, the interface 212 and/or the plunger 186. The locked screen pin 182 may hold the screen rod assembly at length L as shown in FIG. 7. Specifically, the segments 124 of the screen 122 may be maintained in an unfolded and/or extended position prior to insertion of the screen 122 into the screen tensioning system 100.

The screen rod assembly 164 may be inserted into and/or threaded along the sleeve 170 that may extend from the left side 148 and/or the right side 146 of the screen 122. The sleeve 170 may be inserted into and/or correspond with a retention clasp 198 as shown in FIG. 13 that may be associated with the screen tensioning system 100 to hold the screen 22 in place.

Figure 11:
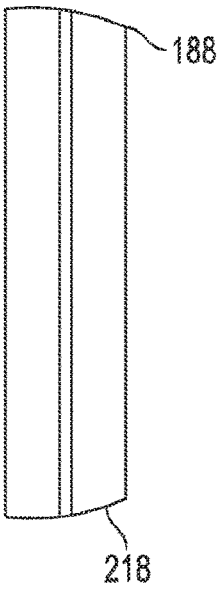
FIG. 11 illustrates a side view of another junction of the screen rod assembly in accordance with an embodiment of the invention.

Referring to FIG. 11, the junction area 166 of the screen rod assembly 164 is shown. An adhesive arc 188 and/or an adhesive arc 218 of material may surround a portion of the screen rod assembly 164 at the junction area 166. The adhesive arc 188 and/or the adhesive arc 218 may assist in movement about and/or rotation around the junction area 168 to, for example, bend and/or fold the section 218 to reduce the length L of the screen rod assembly 164 for storage and/or transport.

Referring to FIG. 12, a first section 192 may contact and/or rotate against a section 194 in contact with the first section 192 across the ball joint 194. In an embodiment, the ball joint 194 may be flat which may assist in insertion of the screen 122 into the screen tensioning system 100. Accordingly, the ball joint 194 may allow for additional contact area between the first section 192 and the section 194 to prevent the first section 192 from sliding apart from the second section 196. Accordingly, the section 218 may be folded along the ball joint 194 by movement of the first section 192 relative to and/or against the section 194 to reduce and/or expand the length L of the screen rod assembly to accommodate insertion of the screen into and/or removal from the screen tensioning system 100. Referring to FIG. 13, a side view of the screen rod assembly 164 associated with the retention clasp 198 of the screen tensioning system 100 is shown. In an embodiment, the retention clasp 198 may be positioned near and/or in contact with a ball box 200 to provide support to the retention clasp 198 and/or contain balls and/or other weighted objects to be vibrated and assist in the operation of the separator 10 as shown in FIG. 3, for example. In an embodiment, the first end 208 and/or the second end 210 of the screen rod assembly 164 may be closed in the sleeve 170 to prevent against, for example, unwanted movement of the screen rod assembly 164 during operation of the separator 10.

Figure 13:
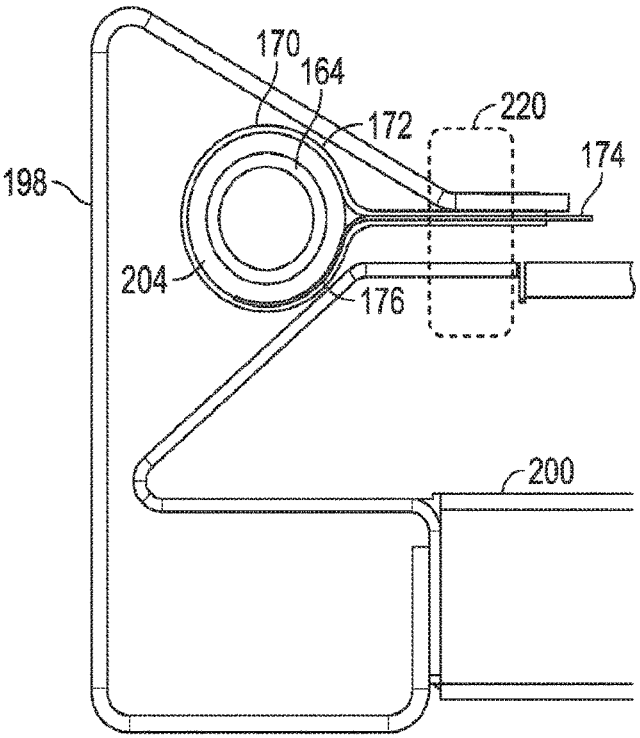
FIG. 13 illustrates a side view of a screen rod assembly inserted into retaining portion of a screen tensioning system in accordance with an embodiment of the invention.

In an embodiment, a screen pinch assembly 220 may generally define where the sleeve 170 enters and/or engages with the retention clasp 198 as shown in FIG. 13. Specifically, the screen pinch assembly 220 may hold the screen 122 in place in the screen tensioning system 100 during operation of the separator 10. In an embodiment, elevated temperatures associated with the operation of the separator 10 may cause the screen 122 to become dislodged and/or otherwise detached from the insertion end 174 of the sleeve 170. Contact between the adhesive layer 172 of adhesive material and the retention clasp 198 may secure the insertion end 174 and/or the screen 122 that may be attached to the insertion end 174. In an embodiment, the screen 122 may wrap around and/or under the spring loaded rod assembly 214 as shown in FIG. 10, for example. The screen tensioning system 100 may be activated upon receiving the screen 122 to pinch the screen 122 by the screen pinch assembly 220, for example, and/or the ball box 200. Accordingly, the screen 122, during operation of the separator 10, may remain in position as desired. In addition, the screen tensioning system 100 may be controlled to prevent against excessive pinching that may damage the screen 122.

Although the preceding description has been described herein with reference to particular means, materials, and embodiments, it is not intended to be limited to the particulars disclosed herein; rather, it extends to all functionally equivalent structures, methods, and uses, such as are within the scope of the appended claims.

The invention claimed is:

1. An apparatus comprising:

a screen rod enclosing an interior wherein the screen rod extends between opposing ends to define a length of the screen rod;

a spring in the interior wherein the spring compresses to reduce the length of the screen rod and further wherein the spring expands to expand the length of the screen rod; and a junction area positioned along the length of the screen rod and extending across a width of the screen rod such that portions of the screen rod are foldable around the junction area onto each other to reduce the length of the screen rod.

2. The apparatus of claim 1 further comprising:

a section on the screen rod defined by the junction area wherein the section folds around the junction area to reduce the length.

3. The apparatus of claim 1 wherein the length of the screen rod is reduced for insertion into a screen rod tensioning system.

4. The apparatus of claim 1 further comprising:

an adhesive arc associated with the junction area along the length of the screen rod.

5. The apparatus of claim 1 further comprising:

a sleeve extending from a foldable screen wherein the sleeve receives the screen rod to reinforce the foldable screen.

6. The apparatus of claim 1 further comprising:

a spring pin extending across the interior wherein the spring pin shortens the screen rod assembly.

7. The apparatus of claim 1 wherein the screen rod is compressed toward a center between the opposing ends.

8. A system comprising:

a screen rod assembly extending from a first end to a second end with a length defined between the first end and the second end wherein the screen rod assembly encloses an interior;

a spring-loaded plunger in the interior wherein the spring-loaded plunger adjusts the length of the screen rod assembly;

a ball joint positioned along the length of the screen rod and extending along a width of the screen rod, wherein the ball joint defines sections of the screen rod assembly that bend around the ball joint to reduce the length of the screen rod; and a sleeve on a screen with segments separated by a fold line extending along a width of the screen wherein the sleeve receives the screen rod assembly to reinforce the screen.

9. The system of claim 8 further comprising:

a spring in the spring-loaded plunger wherein the spring compresses to reduce the length of the screen rod assembly.

10. The system of claim 8 further comprising:

a spring pin in the spring-loaded plunger extending in the interior of the screen rod assembly wherein the spring pin reduces the length of the screen rod assembly.

11. The system of claim 8 further comprising:

a plunger in the interior wherein a compressive force applied to the plunger reduces the length of the screen rod assembly.

12. The system of claim 8 further comprising:

a section of the screen rod assembly that folds around the ball joint.

13. The system of claim 8 wherein the screen rod assembly reduces in length toward a center between the first end and the second end.

14. The system of claim 8 wherein a junction region with the sleeve accepting the screen rod assembly replaces a hinge allowing the segments to fold along the junction region.

15. The system of claim 8 wherein the sleeve extends from the screen to receive the screen assembly rod for operation with a screen rod tensioning system that receives the screen.

16. The system of claim 8 wherein the sleeve attaches to the screen at the fold line.

17. The system of claim 8 further comprising:

a retention clasp associated with a screen tensioning system that receives the screen to hold the screen.

18. The system of claim 8 further comprising:

a screen pinch assembly where the sleeve engages with a retention clasp of a screen tensioning system that receives the screen wherein the screen pinch assembly holds the screen.

19. A method comprising:

providing the apparatus of claim 1;

unfolding the screen rod with segments defined by the joint on the screen rod wherein the segments unfold around the joint;

uncoiling the spring in the interior to extend the screen rod; and inserting the extended screen rod into a sleeve on a screen to reinforce the screen.

20. The method of claim 19 further comprising:

compressing the spring to fold the screen.

21. The system of claim 8, wherein the length of the screen rod assembly accommodates fitment of the screen into a screen rod tensioning system.

* * * * *